United States Patent [19]

Tanaka et al.

[11] 4,220,026

[45] Sep. 2, 1980

[54] POSITION CONTROL METHOD AND APPARATUS FOR CONTROLLING THE POSITION OF THE WIRE DISCHARGING PORT OF A LAYING HEAD

[75] Inventors: Makoto Tanaka, Fuchu; Takayuki Matsudaira, Tokyo, both of Japan

[73] Assignee: Tokyo Shibaura Denki Kabushiki Kaisha, Kawasaki, Japan

[21] Appl. No.: 965,421

[22] Filed: Dec. 1, 1978

[30] Foreign Application Priority Data

Dec. 1, 1977 [JP] Japan ..... 52-144182

[51] Int. Cl.[3] ..... B21B 41/10

[52] U.S. Cl. ..... 72/15; 140/2

[58] Field of Search ..... 72/14, 15; 140/1, 2; 242/82

[56] References Cited

U.S. PATENT DOCUMENTS

| | | | |
|---|---|---|---|
| 3,669,377 | 6/1972 | Gilvar et al. | 140/2 |
| 3,704,610 | 12/1972 | Geipel et al. | 72/14 |

*Primary Examiner*—Lowell A. Larson

*Attorney, Agent, or Firm*—Oblon, Fisher, Spivak, McClelland & Maier

[57] ABSTRACT

A position control system for controlling the position of the wire discharging port of a laying head to discharge a wire in a coil fashion through its revolution, compares a position reference signal which is produced depending on the running speed of a wire at the upstream location of the laying head with a position feedback signal which is produced on the basis of an revolution of the laying head, thereby to cause the laying head to discharge the wire at a desired position of the laying head. A position setter is further provided by which the leading end of the wire is discharged at a desired position.

9 Claims, 14 Drawing Figures

POSITION CONTROL METHOD AND APPARATUS FOR CONTROLLING THE POSITION OF THE WIRE DISCHARGING PORT OF A LAYING HEAD

The present invention relates to an apparatus in which a wire emanating from a finish mill of a wire mill is coiled by a laying head and then is placed on a conveyor and, more particularly, a position control method for controlling the position of the wire discharging port of the laying head so as to position the leading end of the wire discharged from the laying head to a fixed position, and its apparatus.

A wire production line ranging from a finish mill to laying head in a wire mill of this kind is shown in FIG. 1. As shown, a wire X travels in a direction of an arrow Y and passes through a finish mill FM and then is coiled by a laying head LH. The coiled wire CL leaving from the laying head LH is continuously placed on a belt conveyor BL and is collected by a coil collector (not shown) located at the terminal of the belt conveyor and then is bundled for delivery.

As shown in FIG. 2A, the laying head takes a conical shape, and revolves in cooperation with a worm W coupled with a drive motor M2 and a worm wheel WH fixed to the laying head LH. A pipe PI is fastened to the inside of the laying head LH. The wire X enters the pipe PI from a terminal D and is discharged from an exit E or a wire discharging port. The discharging wire is coiled through the revolution of the laying head LH and the coiled wire is dropped on the running belt conveyor BL.

The coiled wire dropped on the belt conveyor traveling in a direction of an arrow Y, as viewed from above, is illustrated in FIGS. 3A and B. When the coiled wire CL discharged from the laying head LH rides on the belt conveyor BL, with the leading end of the wire deviated outward from the coiled portion, as shown in FIG. 3A, the leading end A of the coiled wire frequently tangles at the coil collector so that the operation of the wire production line must frequently be stopped. Further, when the coiled wire CL drops at an improper location on the conveyor BL, the coils wire is excessively deviated to the right or left side as viewed in the conveyor traveling direction so that it contacts with adjacent members or apparatus, resulting in stoppage of the wire production line. For this, it is necessary to place the coiled wire on the belt conveyor travelling in an arrow Y direction so that the leading end of the coiled wire is held by the preceding ring of the coil, as shown in FIG. 3B. For this, by convention, the leading end of the wire traveling with the belt conveyor BL is cut by hand and the cut leading end of the wire is manually positioned at a point A in FIG. 3B.

Accordingly, an object of the invention is to provide a position control method for controlling the position of the wire discharging port of a laying head so that the leading end of the wire is discharged at a desired position.

Another object of the invention is to provide a position control apparatus for controlling the position of the wire discharging port of a laying head so that the leading end of the wire is discharged at a desired position.

A control method for controlling the position of the wire discharging port of a laying head which discharges a wire in a coil fashion through its revolution, comprising the steps of: detecting signals relating a wire running speed and an amount of revolution of said laying head; modifying the detected wire running speed signal into a signal relating to higher wire running speed than the former speed; comparing the detected revolution amount signal with the modified signal when the leading end of the wire reaches an upstream position of said laying head; and feeding a signal of the comparing result to a speed control system of said laying head.

A control apparatus for controlling the position of the wire discharging port of a laying head which discharges a wire in a coil fashion through its revolution, comprising: a detector first for detecting the running speed of a wire; a circuit for modifying the output signal from said detector into a larger signal than the former; a second detector coupled with said laying head and for detecting an amount of the revolution of said laying head; a third detector provided upstream of said laying head and for detecting the wire; a comparator for comparing the output of said modifying circuit with the output of said second detector when said third detector produces an output; a drive system for said laying head in response to the output of said comparator.

Other objects and features of the invention will be apparent from the following description when considered in connection with the accompanying drawings, in which:

FIG. 1 diagrammatically shows a general arrangement of a finish mill, a wire, a laying head and a belt conveyor;

Figure 4:
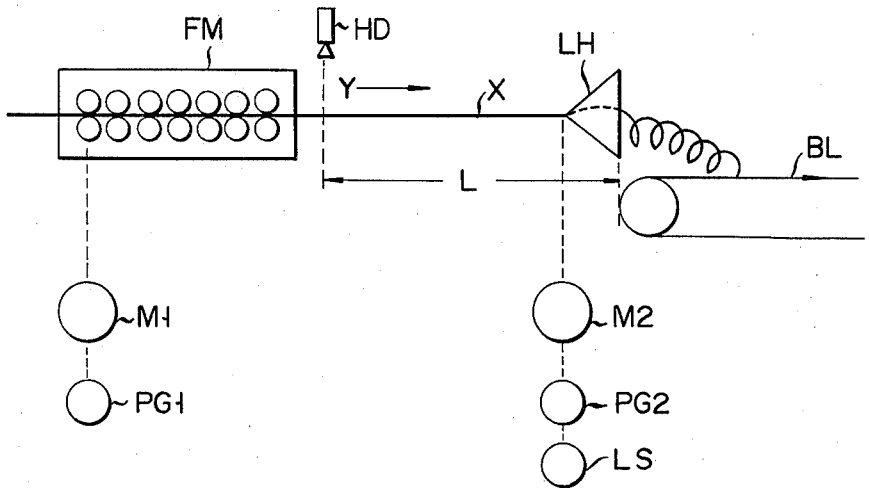
FIG. 4 shows an arrangement of a wire production line.
Figure 8:
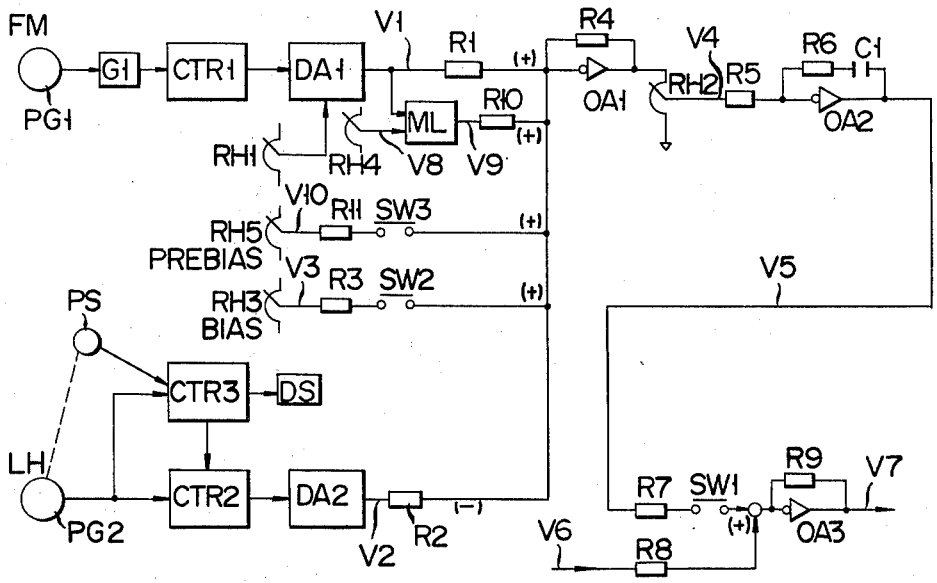
Figure 5:
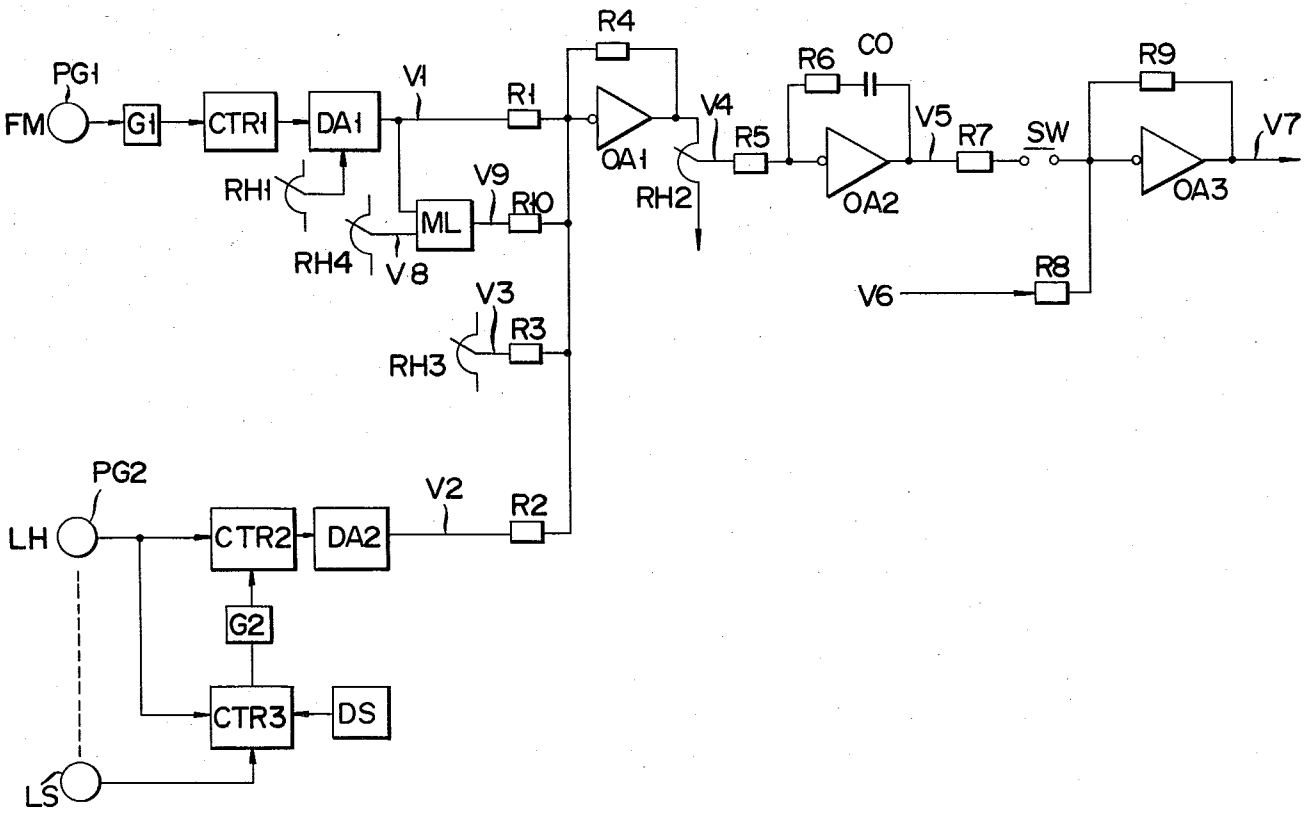
FIG. 5 shows a block diagram of a control system for controlling the wire production line shown in FIG. 4.
Figure 6A:
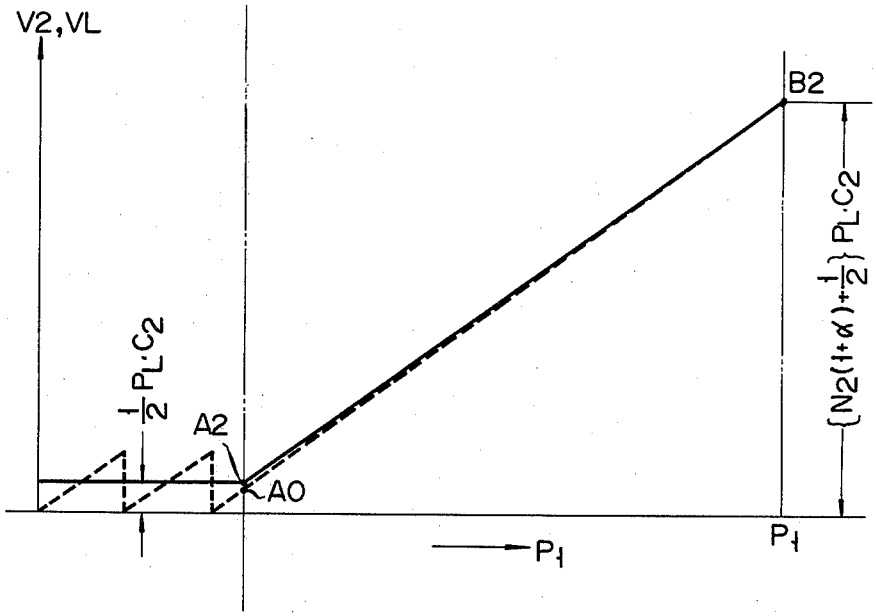
Figure 7:
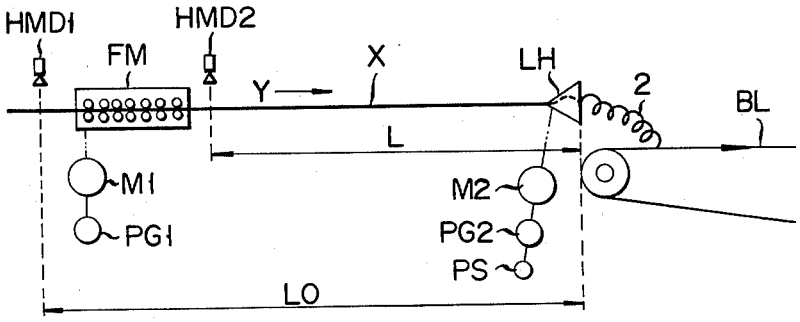
Figure 9:
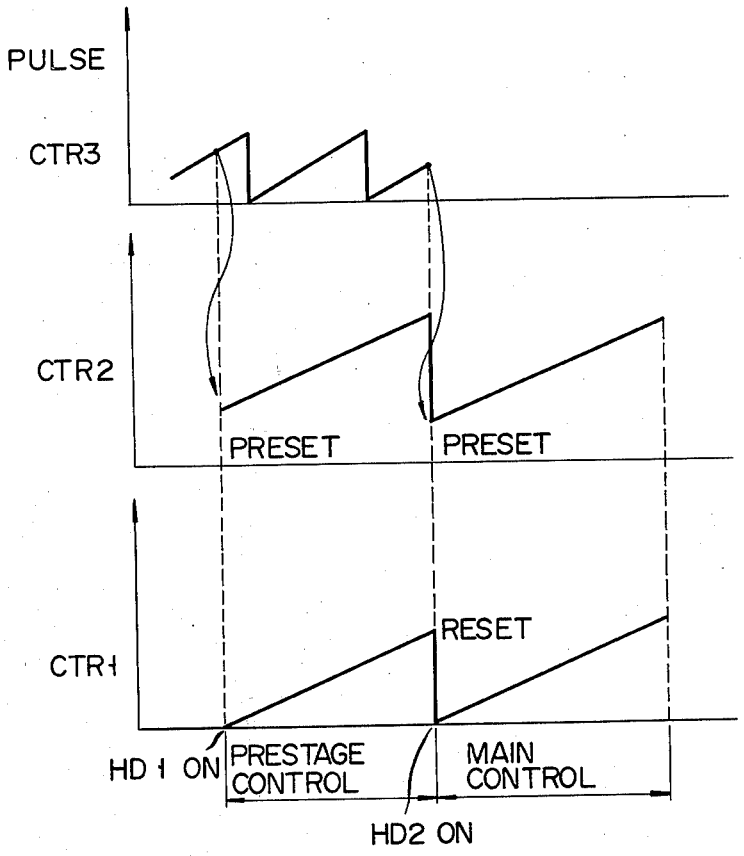
Figure 10A:
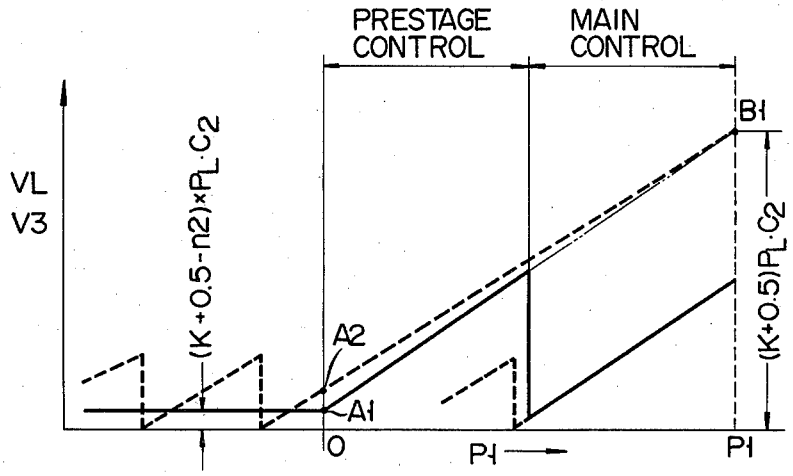
Figure 10B:
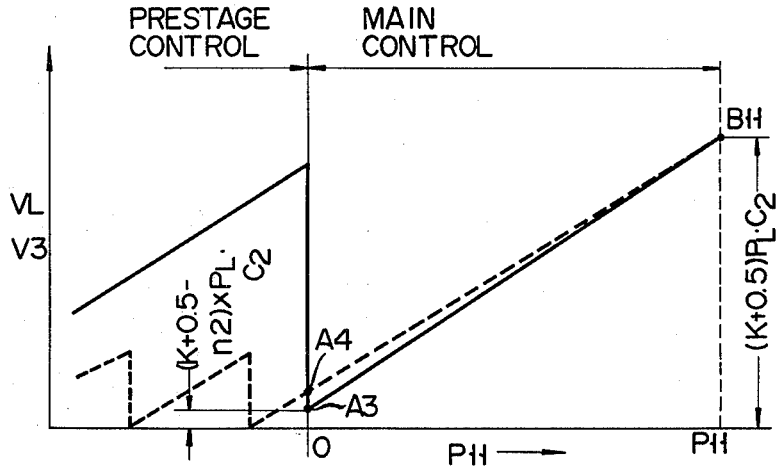

FIGS. 6A and B show timing charts useful in explaining the operation of the control system for the wire production line shown in FIGS. 4 and 5;

FIG. 7 shows an arrangement of a wire production line illustrating another embodiment of the invention;

FIG. 8 shows a block diagram of a control system for controlling the wire production line shown in FIG. 8; and FIGS. 9 and 10A and 10B show timing charts for illustrating the operation of the wire production line.

Figure 1:
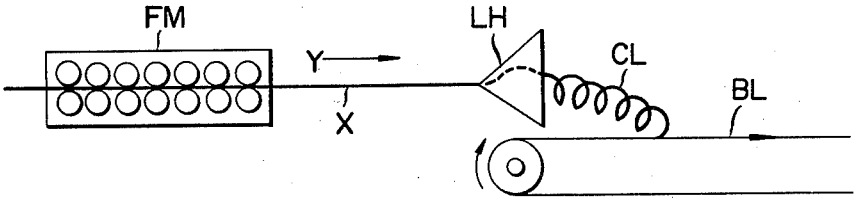
FIG. 1 PRIOR ART

A description to first be given referring to FIGS. 4 and 5 is how to position the leading end of a wire X discharged from a laying head LH under control of a laying head positioning apparatus which is an embodiment of the invention. FIG. 4 shows a schematic diagram of an overall wire mill with a hot metal detector HD. In the figure, like reference numerals are used to designate like portions in FIG. 1 and the description of the wire flow in FIG. 1 is correspondingly applied to that in FIG. 4.

A finish mill FM is driven by a motor M1 coupled with a pulse generator PG1. A laying head LH is driven by another drive motor M2 coupled with a pulse generator PG2 further connecting to a position switch LS to be referred to later. HD, which is disposed upstream a distance L away from the laying head LH, detects the leading end of a wire X emanating from the finish mill FM. The number of rotations of the drive motor M1 when the wire X travels a distance l is given where M is the gear ratio of a roll to the drive motor M1, f is a forward slip by which the wire X travels ahead with respect to the roll peripheral speed and $D_M$ is the diameter of the roll at the final stand of the finish mill.

The number pl of pulses generated by the pulse generator PG1 when the drive motor M1 rotates $n_1$ times is expressed $$pl=n_1\times P_M \quad (2)$$

where $P_M$ designates the number of pulses generated by the pulse generator PG1 attached to the drive motor M1. When the the peripheral speed of the laying head LH is equal to the traveling speed of the wire X at traveling downstream of the finish mill, the number of revolution $n_2$ of the laying head LH when the wire X travels the distance l is $$n_2=\frac{l}{1/\pi D_L} \quad (3)$$

where $D_L$ is the diameter of a circle along the wire discharging port or exit E of the laying head.

With a designation of $P_L$ for the number of pulses generated by pulse generator PG2 attached to the drive motor M2 for each revolution of the laying head LH, the number $p_2$ of pulses generated by the pulse generator PG2 when the laying head LH revolves $n_2$ times is given by the following equation $$p_2=n_2\times P_L=1/D_L\times P_L \quad (4)$$

Figure 2A:
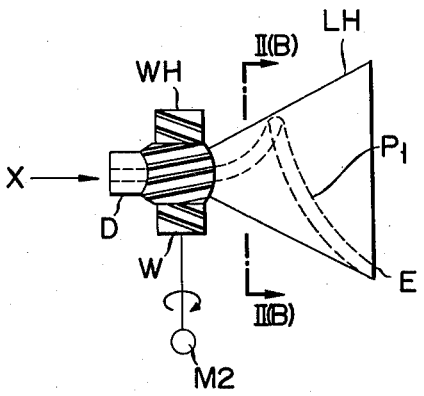
FIG. 2A PRIOR ART
FIG. 2A shows a side view of the laying head shown in FIG. 1.
Figure 2B:
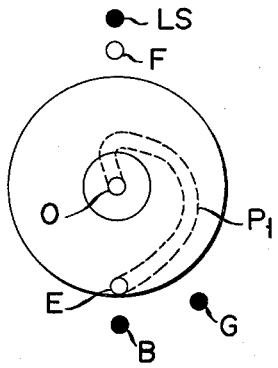
FIG. 2B PRIOR ART
FIG. 2B shows a front view of the laying head as viewed in an arrow direction.
Figure 3A:
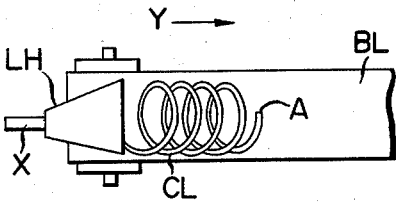
FIG. 3A PRIOR ART
FIGS. 3A and 3B show a state of the coiled wire discharged from the laying head shown in FIG. 1 onto the belt conveyor, particularly illustrating the different positions of the leading end of the wire coiled.

FIG. 2B shows a diagram of the laying head LH as viewed in a direction of arrow 2B in FIG. 2B. In the description to be given, an assumption is made that, when the wire X is discharged when the discharge port E of a pipe PI reaches a point B in FIG. 2B, the leading end of the coiled wire is positioned at a desirable point A (referred to as a target point) shown in FIG. 3. Another assumption is made that the count zero of pulse count of the laying head LH is set to a point F, distanced by a semicircle length from the target point B, i.e. to a situation where the laying head LH reaches the point F. The point F is referred to as a interim point. The position switch LS attached to the pulse generator PG2 is positioned at the location of the point F or the interim point. Accordingly, in FIG. 2B, when the discharge port E comes to the point F, the position switch LS is actuated. Since the interim point F corresponds to the zero count of pulse, the number of pulses at the point B, i.e. the target point, is given by $P_L/2$.

The leading end of wire position control system according to the invention will be described with reference to FIG. 5. In FIG. 5, a gate G1 remains open so long as the hot metal detector HD disposed downstream of the finish mill FM detects the wire X. Accordingly, a pulse counter CTR receives a pulse from the pulse generator PG1 to initiate an addition when the leading end of the wire X reaches HD. The total pulse number Pcl counted by CTR1 when the wire X advances a distance L from HD to the discharge port E, is given from the equations (1) and (2)

$$Pcl=L/\pi D_M M(l+f)\times P_M \quad (5)$$

A digital to analog converter DA1 converts a digital signal Pcl from CTR1 into an analog signal V1 which is in turn applied as a reference signal for synchronous position correction of the laying head LH to an operational amplifier OA1. The output V1 represents the amount of rotation of the finish mill FM. A variable resistor RH1 connecting to the DA1 is used to adjust a D-A converting coefficient C1 of OA1 in accordance with the roll diameter of the finish mill FM. Another variable resistor RH4 for lead speed setting sets up the ratio $\alpha$ (referred to as a lead factor) of the leading peripheral speed of the laying head LH to the wire speed. A multiplier ML multiplies the output V8 from RH4 and the output V1 of the DA converter DA1 and the product signal V9 of the multiplier is applied as a lead speed correction signal of the laying head LH to the operation amplifier OA1, together with the output V1.

A sampling counter CTR2 for counting the pulse number from the pulse generator PG2 is reset each revolution of the laying head LH and starts its count again from zero, until the leading end of the wire X reaches the detector HD. The timing for resetting the sampling counter CTR2 is produced by a preset counter CTR3. Every time that the exit E of the laying head LH comes to the interim point F, a signal from the position switch PS for detecting a situation where the exit E reaches the interim point F, presets a set value $P_{DS}$ of a position setter or a digital switch DS in the present counter CTR3. The set value $P_{DS}$ falls within a range from $0\leqq P_{DS}<P_L$ defined by the equation (21). Upon receipt of a pulse from the pulse generator PG2, the present counter CTR3 performs a subtraction from the preset value $P_{DS}$ and, when the result of the subtraction becomes zero, that is to say, the exit E comes to the position separated by $P_{DS}$ from the interim point F in rotational direction, the preset counter delivers a rest signal to the sampling counter CTR2. When the leading end of the wire X reaches HD, the gate G2 is closed and then the sampling counter is not reset and continuously counts pulses from the pulse generator PG2 until the wire X reaches the exit E.

When the laying head LH revolves with a lead factor $\alpha$ (%) with respect to the peripheral speed of the laying head LH, the pulse number $p_2$ of pulses from the pulse generator PG2 when the wire X runs the distance l, is $$P_{2\alpha}=l/\pi D_L\times(l+\alpha)P_L \quad (6)$$

From the equation (3), $l/(\pi D_L)=n2$ and therefore the equation (6) is transformed into the following equation $$P_2=n_2(l+\alpha)P_L \quad (7)$$

When the leading end of the wire X reaches the exit E, the rotation angle of the laying head LH is so controlled that the exit E is positioned at the target point B. If so controlled, when the leading end of the coil is discharged to be at a desired position as the point A shown in FIG. 3B, the zero point of count by the sampling counter CTR2 is set at the position where the the exit E advances by pulses $P_{DS}$ in rotational direction from the interim point F, as mentioned above, and therefore if the laying head LH is controlled to satisfy the following equation $$P_{c2}+P_{DS}=Po+P_2+P_{DS}=(K+\tfrac{1}{2})P_L \quad (8)$$

where Po is count of the sampling counter CTR2 when the leading end of the wire X reaches the HD, $P_2$ is the number of pulses of the generator PG2 when the wire X moves the distance L, and Pc2 is count of the sampling counter CTR2 at that time, the exit E is controlled to be positioned at the target point B distanced by ½ rotation of the laying head LH, i.e. $P_L/2$ pulse, from the interim point F, when the leading end of the wire X comes to the exit E.

The output V2 of the digital to analog converter DA2 is applied as a position feedback signal of the laying head LH applied to the operational amplifier OA1, differentially with the signal V1.

The D-A converting coefficients C1 and C2 of D-A converters DA1 and DA2 are related in the following equation $$C1\ n_1 P_M + C1\ n_1\ P_M = C2(l+\alpha)n_2\ P_L \quad (9)$$

The equation (9) is transformed into the equation (10)

$$C1\ n_1\ P_M = C2\ n_2\ P_L \quad (10)$$

The output V3 of a variable resistor RH3 for setting a bias voltage V3 is set to a value $V3 = C2\ \frac{1}{2}P_L$ corresponding to the pulse number $P_L/2$ and is applied to the operation amplifier OA1, addtionally with the output V1. Accordingly, the position reference output $V_L$ of the laying head LH with respect to a proper number $P_1$ of pulses counted from zero of pulse from pulse generator PG1 (finish mill) is given $$\begin{aligned} V_L &= V1 + V3 + V9 \\ &= C1\ pl + \tfrac{1}{2}\ C_2 P_L + Clpl \\ &= C1\ (1+\alpha)pl + \tfrac{1}{2}\ C_2 P_L \end{aligned} \quad (11)$$

This relation is depicted as a straight line A1, B1 in FIG. 6A. In the graph in FIG. 6A, the abscissa represents pulse number p1 of the pulse generator PG1 (finish mill) and the ordinate the position reference output $V_L$ of the laying head LH and the output V2 of the D-A converter DA2, and the bias output V3 is represented by $\overline{OA1}$. When $pl = P1$, the position reference output $V_L$ is expressed by the following equation (12), from the equations (2), (11) and (12)

$$V_L = C2\ N2(l+\alpha) + \tfrac{1}{2}\ P_L \quad (12)$$

Therefore, the set value $P_{DS}$ of the position setter DS is $$P_{DS} = \{K - N_2(l+\alpha)\}P_L \quad (13)$$

In the equation (13), when $O \leqq P_{DS} < P_L$ and K is a positive integer, the equations (12) and (13) lead to the following equation (14), when the leading end of the wire X comes to the exit E, $$\begin{aligned} Pc2 + P_{DS} &= N2\ (1+\alpha) + \tfrac{1}{2}\ P_L + K - N_2\ (1+\alpha)\ P_L \\ &= (K + \tfrac{1}{2})P_L \end{aligned} \quad (14)$$

and the exit E of the laying head LH is controlled to be positioned at the target point B.

The description thus far made is related to a case where the target point is B. In the description to follow, the target point is set to a point G in FIG. 2B. That is to say, the target point is set to a point distanced by an angle $\theta$ (=∠BOG) in the revolutional direction of the laying head LH from a reference point B. In this case, the setting value $P_{DS}$ of the digital switch DS is expressed by $$P_{c2} + P_{DS} = (K + \tfrac{1}{2} + \theta/360)P_L \quad (15)$$

Therefore, $$\begin{aligned} P_{DS} &= (K + \tfrac{1}{2} + \theta/360)P_L - P_{c2} \\ &= (K + \tfrac{1}{2} + \theta/360)P_L - \{N_2\ (1-\alpha) + \tfrac{1}{2}\}\ P_L \\ &= \{K + \theta/360 - N_2\ (1+\alpha)\}\ P_L \end{aligned} \quad (16)$$

In the equation, of $O \leqq P_{DS} < P_L$ when the leading end of the wire X arrives at the exit E, the exit E is controlled to be positioned at the point G.

Then, an operational amplifier OA2 receives a difference signal V4 between the position reference output $V_L$ and the position feedback signal $V_2$ to produce an output V5 which in turn is applied as a signal for correcting the position of the laying head LH is applied to an operational amplifier OA3, additionally with a synchronous reference input V6 which is equal to the speed reference signal of the drive motor M1. The output V7 of the operational amplifier OA3 becomes a speed reference signal for an automatic control system (not shown) of the laying head LH to drive the laying head drive motor M2. The contact SW is closed from the instant when the leading end of wire arrives at HD until it reaches the exit E of the laying head LH. More specifically, the contact SW is made to close by the signal of HD and is made to open by a timer after the lapse of a given time (the time point that the leading end of the wire comes to the exit E of the laying head). The reason why the contact SW is used is that, after the leading end of the wire is discharged, it is necessary to drive the laying head so as to have the same speed as the line speed reference V6.

Then, when the leading end of the wire reaches the HD, for example, if the count of the pulse counter CTR2 is Po, the output V2 of the D-A converter DA2 at this instant becomes a point Ao in FIG. 6A and a difference $\overline{A0A1}$ between it and the position reference output $V_L$ of the laying head LH is applied as an equivalent difference input signal to the operational amplifier OA1. This changes the speed reference of the speed control system (not shown) of the laying head LH to initiate the position correction operation of the laying head LH. Succeedingly, a difference signal between the laying head position reference signal represented by a line A1 and B1 and an actual position feedback signal of the laying head LH as indicated by a dotted line A0 and B1, causes the speed reference of the laying head LH to change. Accordingly, at the time that the wire head reaches the exit E, the error or difference has become zero and the exit E has reached the wire discharging point B in FIG. 2B. In the vicinity of a point B1 in FIG. 2B, the line A1 and B1 is coincident with the curve A0 and B1 and this implies that the laying head LH and the speed of the wire X are completely synchronized to each other.

When the output V2 of the laying head position feedback signal lies at the point A1 in FIG. 6A at the instant that HD detects the wire X, the wire head moves along the line A2 and B2. When the output V2 lies at the point A0 in FIG. 6A, the laying head LH is subjected to the position correction along the curve A0 and B3 and, when the leading end of the wire reaches the exit E, the exit E of the laying head LH reaches the wire discharging target position B in FIG. 2B.

Figure 6B:
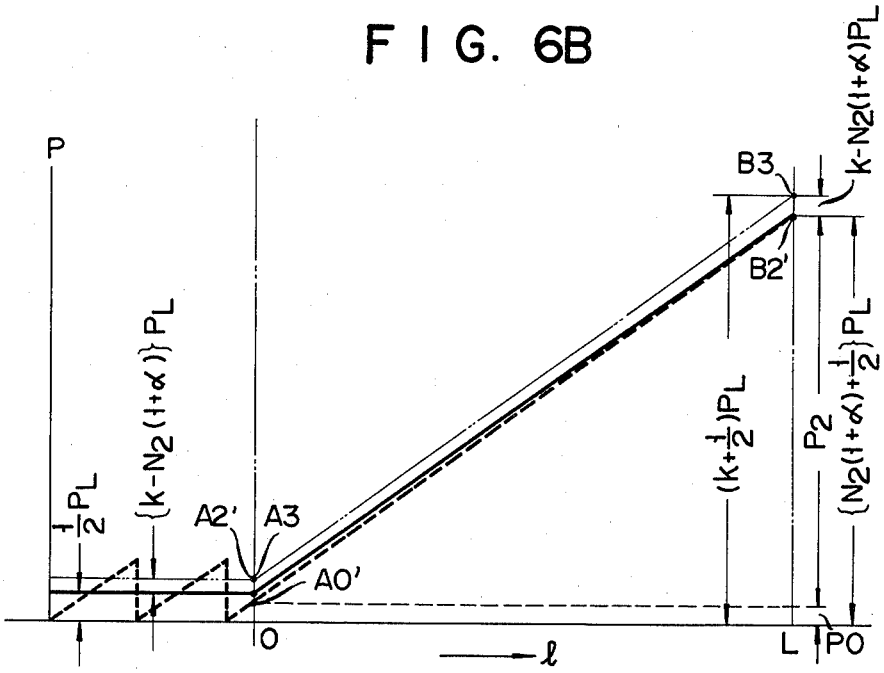

FIG. 6B illustrates the same thing as that of FIG. 6A, with different parameters on the abscissa and ordinate. In FIG. 6B, the abscissa represents the distance l from HD in the laying head LH direction, in place of the pulse number p1 of the pulse generator PG1 (finish mill) and the ordinate represents the pulse number p corresponding to the position reference output $V_L$ for the laying head LH and a feedback signal V2 of an actual position of the laying head LH. In the figure, a line A1' and B1' represents the position reference pulse number of the laying head LH and a curve A0' and B1' the pulse number of the feedback signal of an actual position of the laying head LH. A difference between the line A2' and B2' and the curve A0' and B2' serves as an error correction signal. When the wire X advances a distance L, i.e. the leading end of the wire reaches the exit E, the error correction signal has already been zero and the pulse number of the laying head LH becomes $\{N2(H+\alpha)+\frac{1}{2}\}P_L$. The line A2 and B2 corresponds to the pulse number of the position reference pulse of the laying head LH when the zero count is shifted from the exit E to the interim point F, and this is equal to the parallel shifted A1' and B1'. The set value $P_{DS}$ by the position setter DS has been selected, by the equation (21), to be the pulse number equal to $\overline{B1'\ B2}$ in FIG. 6B. When the leading end of the wire arrives at the exit E, the exit E has come to the discharging target point B.

As described above, the position control system of the laying head according to the invention attains many useful effects. One of them is to eliminate the troublesome work to manually cut the end of the coil head, if necessary, by observing the coil leading end. For this, the wire mill may be completely automated when the laying head position control system is employed. Further, the peripheral speed of the laying head may be changed from the synchronous speed with respect to the speed of the wire to a speed with a lead factor, with a minimum time, through which the laying head is position-controlled. The optimum target point for wire discharging may be set properly in accordance with the wire speed and the lead factor. Consequently, the use of the position control system of the invention enables a wire mill to operate economically, effectively and highly accurately.

In the example mentioned above, the pulse count is converted, by the D-A converter, into an analog quantity and then is subjected to an adding operation to detect a deviation. However, the digital amount of the pulse count is directly subjected to the addition for detecting the deviation.

The position control system, which has been described relating to the position control of the leading end of a wire, is also applicable for controlling the position of the interim part of the wire and the trailing end of the wire.

In the above example, the position control of the laying head is carried out one time. In an alternation of it, a plurality of the wire detectors HD are used and a milling line is divided into a plurality of segmental lines and the position control system of the invention is applied to the respective sequential lines. The alternation will be elaborated below.

In brief of the alternation, HMDs are provided at both input and output sides of the finish mill. Two or more control stages are provided in the wire running course ranging from the input side of the finish mill to the laying head LH. The effect attained is that the accuracy of the wire discharge position control is improved.

Reference is made to FIGS. 7 through 10. As shown in FIG. 7, hot metal detectors HMD1 and HMD2 are provided at the input and output sides of the finish mill FM, respectively, to effect two stage control. Like reference numerals designate like portions in FIG. 1 and the control flow in the overall wire milling line is the same as that in FIG. 1. No further explanation of this will be given.

As shown, the first HMD 1 is disposed at the location a distance Lo away from the laying head LH and the second HMD 2 a distance L from the same. The leading end of the wire X enters the finish mill X is detected by the first HMD 1 and the leading end thereof leaving the finish mill FM is detected by the second HMD 2.

Turning now to FIG. 8, there is in block form illustrated the control system in the example. Like reference symbols are applied for the designation of like portions in FIG. 5. The explanation of such portions will be omitted for simplicity. In the figure, a gate G1 is opened when the leading end of the wire travels in the section between the first and second HMD 1 and HMD 2 and when the second HMD 2 detects the wire leading end X. The pulse of the pulse generator PG1 attached to the drive motor ML is applied to a pulse counter CTR 1, via the gate G1. The output of CRT 1 is subjected to a digital to analog conversion in the digital to analog converter DA1 and then is applied to an operational amplifier OA1. This signal is a reference signal for correcting the laying head position. The pulse counter CTR1 is reset when the leading end of the wire is detected by the first or the second laying head HMD 1 or HMD 2 and when the leading end of the wire reaches the laying head LH, and continues the counting of pulses from the pulse generator PG1 until it is next reset.

The pulse of the pulse generator PG2 coupled with the laying head side is applied to the pulse counter CTR 2 and CTR 3. The output of the pulse counter CTR 2 is subjected to the D-A conversion in the D-A converter DA2. The output V2 of the converter DA2 is applied to the operational amplifier OA1, differentially with the output V1. This serves as a feedback signal of the laying head position, as described in the example of FIGS. 4 and 5.

The output V3 of the variable resistor RH3 is applied through a switch SW2, to the operational amplifier OA 1; the output V10 of the variable resistor RH 5 is applied through a switch to the same. These outputs V3 and V10 are applied as bias voltages to the amplifier OA 1, differentially with the output V1. These outputs V1, V10 and V3 or V8 are applied through operational amplifiers OA 1 and OA 2 to an operational amplifier OA 3. R1 to R10 designate operational resistors of the operational amplifiers, C1 a capacitor, and RH3 a variable resistor for gain adjustment. Variable resistors RH1 and RH4 and a pulse counter CTR 3 will be described later.

The output V5 of the operational amplifier OA 2 serves as a signal for correcting the position of the laying head LH, and is applied to the operational amplifier OA 3, differentially with a synchronous reference input V6 which is the same as the speed reference of the drive motor for driving the finish mill. The output V7 of the operational amplifier OA 3 drives the drive motor M2 for driving the laying head.

The operation of the position control system will be given in the phase from the instant when the wire X reaches the first HMD 1 to the laying head LH. In the description, the control when the wire X advances from HMD 1 to HMD 2 is referred to as a prestage control and the control after the wire has passed the second HMD 2 is referred to as a main control.

When the leading end of the wire x reaches HMD 1 or HMD 2, the contents of the pulse counter CTR 3 is preset in the counter CTR 2. Then, the pulse counter CTR 2 continuously counts from the preset value the pulses from the pulse generator PG2 during the time from the instant that the leading end of the wire passes HMD 1 till it reaches HMD 2, and during the succeeding time that the wire X passes the second HMD 2 and reaches the laying head discharging port. FIG. 9 shows how this count is made.

Firstly, HMD 1 detects the wire X so that the pulse counters CTR 1 and CTR 2 are reset and preset and the prestage control starts. The output of these counters are applied to the converters DA1 and DA2, respectively. The switch SW3 is closed only in the prestage control and the output V10 of the prebias setter RH5 is set to have a value V10=C2 P3 corresponding to the pulse number expressed by the equation (7).

$$P3=(K+\tfrac{1}{2}-n2)\,P_L \tag{17}$$

Accordingly, the position reference output $V_L$ of the laying head with respect to a proper pulse number P1 between zero of HMD 1, which is so set, and P1, $$V_L = V8 + V1 = V8\ C1P1 = C2\,(K+\tfrac{1}{2}-n2)\,P_L + C1P1 \tag{18}$$

The relation expressed by the equation (18) is diagrammatically illustrated in FIG. 10A. In the figure, the abscissa represents the pulse number p1 of the finish mill and the ordinate represents position reference output $V_L$ of the laying head the output V2 of the digital to analog converter DA2. The bias output is expressed by OA1. When the leading head A of the wire X reaches the wire discharging port or exit of the laying head, that is to say, when p1−P1, the position reference output $V_L$ of the laying head, as described above, is $$V_L=C2\,(K+\tfrac{1}{2})\,P_L \tag{19}$$

As seen from the equation (19), the position reference output $V_L$ represents a position instruction including an integer number K (the first term on the right side) of revolution and the wire discharging target point which is ½ revolution (the second term) away from the interim point F and corresponds to the point B in FIG. 2(*b*). This corresponds to a point B1 shown in FIG. 10A. At the instant that the leading head of the wire X reaches HMD 2, the control is switched from the prestage control to the main control. At this time, CTR 1 is reset and the contents of CTR 3 is preset in CTR 2, as at the initiation of the prestage control. The preset value of CTR 2 is inputted into the D-A converters DA 1 and DA 2. When the wire discharging position of the laying head LH has been corrected in the prestage control, that is to say, when the feedback signal of the laying head position is coincident with the position reference signal $V_L$ before the leading end of the wire X reaches the second HMD 2, the analog value obtained when pulse number preset in the pulse counter CTR 2 when the control is switched to the main control is converted from digital to analog form is equal to the bias value set by the adjusting resistor RH1. For this, no position correction signal is needed in the main control.

Even when the exit position of the laying head is incompletely corrected in the prestage control, a small amount of the position correcting operation is merely left in the main control and hence a short time is necessary for the position correcting operation. The conversion coefficients C11 and C12 of the digital to analog converters DA1 and DA2 are given by the equation (20)

$$C11\ n1\ P_M=C12\ n2\ P_L \tag{20}$$

In the above equation, n1 and n2 are given by the equations (2) and (1). The distance S in the equations (1) and (2) corresponds to the distance L from HMD 2 to the laying head LH. When the equations (5) and (20) are compared, with respect to n1 and n2, the distance S is substituted by the distances Lo and L and therefore we have C1=C11 and C2=C12. This implies that the same D-A conversion ratio may be applied for the pulse counters in the prestage and main controls.

The switch SW2 is closed only in the main control. The output V2 of the bias setter RH3 is set to be a value $V2=C12\ C13$, which corresponds to pulse number P13 given by the following equation (21)

$$P13=(k+\tfrac{1}{2}-n2)\,P_L \tag{21}$$

The position reference output $V_L$ of the laying head with respect to a proper pulse number P11 between zero of HMD 2, which is so set, and P1, is given $$V_L = V2 + V1 = V2 + C1\ P11 = C2(K+\tfrac{1}{2}-n2)P_L + C1\ P11 \tag{22}$$

This relation is diagramatically illustrated in FIG. 10B. The graph in the figure has pulse number P11 of the finish mill as the abscissa and the position reference output $V_L$ of the laying head LH and the output V3 of the D-A converter DA2 as the ordinate. The bias output is represented by OA3. When $p11=p1$, it is the same as the equation (19), the position reference output $V_L$ serves as a position instruction including an integer number K (first term on the right side) of revolution and the wire discharging target point which is ½ revolution (second term) away from the interim point F and corresponds to the point B in FIG. 2B.

This target point corresponds to a point B11 in FIG. 10B. At the instant that the second HMD 2 detects the wire X, if the output V3 of the digital to analog converter DA2 at the laying head side, which is a feedback signal, lies at a point A3 in FIG. 10B, the output V3 at the laying head side also increases along a straight line A3–B11. This is similarly applied to the prestage control. At the instant that the first HMD 1 detects the wire X, if the output V2 of the converter DA2 is located at a point A1 in FIG. 10*a*, the output V2 at the laying head side rises along a straight line A1–B1.

Accordingly, the output V5 of the operational amplifier OA2, i.e. a signal for correcting the laying head position, is zero so that no position correcting operation is necessary. In other words, when the wire leading end A reaches the wire discharging port or exit E of the laying head, the exit E of the laying head also arrives at the wire discharging target point, the point B in FIG. 2B. At the instant that the wire leading head A reaches HMD with the count of Po' of the pulse counter CTR3, it is assumed that the output V3 of the D-A converter DA2 is positioned at a point A4 in FIG. 10B. In this case, a difference A3–A4 between the position reference output $V_L$ of the laying head and the output V3 serves as an equivalent error input signal of the operational amplifier OA1. This signal changes the speed reference of a speed control system for the laying head LH which is not shown and operates at the synchronous reference V6 in FIG. 5 to initiate the correction operation of the laying head position.

Subsequently, a difference between the line A3–B11 of the laying head position reference signal and the dotted line A4–B11 of the feedback signal of an actual position of the laying head LH, changes the speed reference of the laying head LH. Accordingly, when the leading end A of the wire reaches the exit E of the laying head LH, the error has been zero and the exit E has reached to the target point B in FIG. 2B. In the vicinity of the point B11 in FIG. 10B, the lines A3–B11 and A4–B11 coincide with each other in inclination. Similarly, in the vicinity of the point B1 in FIG. 10A, the lines A1–B1 and A2–B1 similarly coincide with each other. This implies that the speed of the laying head LH completely coincides with that of the finish mill and that the wire X may be wound up smoothly.

The finish mill is comprised of a plurality of mills. The finish size of the rolled member is determined by the mill stand selected as the final stage from those mill stands. This mill stand selection is called a stand selection. Upon the stand selection, the running speed of the wire changes at the output side of the finish mill so that the apparent distance between HMD 1 and HMD 2 of each stand selected changes and thus the prebias value changes. An amount of the prebias change must be corrected. Although a single prebias setter of RH4 is illustrated in FIG. 5, when the stand selection is necessary, the bias setters with the same number as that of the mill stages to be stand-selected are used and that prebias change is corrected by changing the set value in accordance with the stand selection.

Further, the stand selection causes the apparent distance between HMD 1 and HMD 2 to change. For this, this also changes the change ratio of output pulses number from the pulse generator PG1 to the distance change. It is for this reason that correction is made to make the change ratio equal to the change ratio of output pulse number from the pulse generator PG2 to the distance change, by changing the conversion ratio of the digital to analog converter DA1.

In case where the stand selection is needed, the adjusting resistors, or setters, with the same number as that of stages to be stand-selected are used (although the FIG. 5 example uses only one adjusting resistor RH1 for the correction) and the conversion ratio is changed by the output in accordance with the stand selection thereby to effect the stand selection. The digital to analog converter has an output Ao given by the following equation (23)

$$Ao = \alpha p \cdot D_M \cdot M \qquad (23)$$

where M is the gear ratio M of the finish mill, $D_M$ is a roll diameter, and p is count of pulse number. As seen from the equation (23), the output Ao of the D-A converter is proportional to the roll diameter. Thus, the resistor RH1 is used to effect a correction when the roll diameter changes.

Figure 3B:
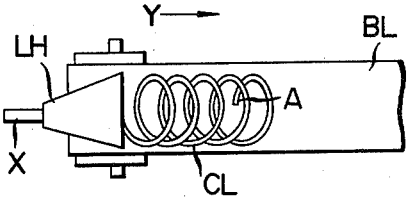
FIG. 3B PRIOR ART

As described above, when the leading end of the wire X reaches the exit E of the laying head LH, the exit E may be controlled so as to be positioned at the target point B in FIG. 3B. Therefore, if the system of the invention is used, the wire winding-up may be fully automated. Further, provision of the prestage control alleviates the control work in the main control so that the wire running speed is high and the laying head position can surely be controlled within a time period till the wire leading end reaches the exit E of the laying head.

In the embodiment mentioned above, the pulse count is converted into an analog quantity and then is subjected to an addition operation thereby to obtain a deviation. However, the digital to analog conversion is not essential. The pulse count in digital form may be directly used for the deviation obtaining process. The above-mentioned embodiment is so designed that the output of the bias resistor RH1 was fixed to set the wire discharging position at a fixed target position. The target position may be set at a proper location by changing the output of the bias resistor RH3. The position control system of the invention is applicable for the position control of a middle part of the wire.

As seen from the foregoing description, the present invention may provide a laying head position control method for effectively positioning the leading end of a wire discharged from the laying head at a desired position and its apparatus.

We claim:

1. A control method for controlling the position of the wire discharging port of a laying head which discharges a wire in a coil fashion through its revolution, comprising the steps of:
   - detecting signals relating to a wire running speed and an amount of revolution of said laying head;
   - modifying the detected wire running speed signal into a signal relating to a higher wire running speed than the former speed;
   - comparing the detected revolution amount signal with the modified signal when the leading end of the wire reaches an upstream position of said laying head; and
   - feeding a signal of the comparing result to a speed control system of said laying head.

2. A control method according to claim 1, in which the comparing result signal is fed to a drive control system of said laying head only during a time interval from the instant that the wire leading end reaches a position till it reaches the wire discharging port of said laying head.

3. A control method according to claim 1, in which said step to detect the signal relating to the revolution amount of said laying head is further comprised of counting an amount of revolution with one revolution of said laying head, clearing it at a given position, and stopping the clearing operation when the leading end reaches a position.

4. A control method according to claim 3, in which the position where said clearing is made in the step for detecting the signal relating to the revolution amount of said laying head, is adjustable.

5. A control method according to claim 1, in which the position of said laying head is controlled upstream of a wire mill.

6. A control apparatus for controlling the position of the wire discharging port of a laying head which discharges a wire in a coil fashion through its revolution, comprising:

a detector first for detecting the running speed of a wire;

a circuit for modifying the output signal from said detector into a larger signal than the former;

a second detector coupled with said laying head and for detecting an amount of the revolution of said laying head;

a third detector provided upstream of said laying head and for detecting the wire;

a comparator for comparing the output of said modifying circuit with the output of said second detector when said third detector produces an output;

a drive system for said laying head operating in response to the output of said comparator.

7. A position control apparatus according to claim 6, in which said laying head drive system responds to the output of said comparator only when the leading end of the wire lies between said second detector and said laying head.

8. A position control apparatus according to claim 6, in which said second detector is provided with a setter to set the position of the wire discharging port of said laying head.

9. A position control apparatus according to claim 6, in which a fourth detector is further provided upstream of the wire mill, having a first control system which responds to the output of said fourth detector to control said laying head and a second control system which responds to the output of a wire detector disposed between said fourth detector and said laying head, thereby to control said laying head.

* * * * *